US010989494B1

(12) United States Patent
Sylvester

(10) Patent No.: US 10,989,494 B1
(45) Date of Patent: Apr. 27, 2021

(54) FIREARM HANDGUARD SYSTEM

(71) Applicant: Bootleg Inc., Boise, ID (US)

(72) Inventor: Dean Sylvester, Boise, ID (US)

(73) Assignee: Bootleg Inc., Kuna, ID (US)

( * ) Notice: Subject to any disclaimer, the term of this patent is extended or adjusted under 35 U.S.C. 154(b) by 0 days.

(21) Appl. No.: 16/879,654

(22) Filed: May 20, 2020

Related U.S. Application Data

(60) Provisional application No. 62/850,463, filed on May 20, 2019.

(51) Int. Cl.
*F41C 23/16* (2006.01)
*F41A 21/48* (2006.01)

(52) U.S. Cl.
CPC ..... *F41C 23/16* (2013.01); *F41A 21/48* (2013.01)

(58) Field of Classification Search
CPC ..... F41A 23/16; F41A 21/48
USPC ..... 42/71.01, 72, 75.03
See application file for complete search history.

(56) References Cited

U.S. PATENT DOCUMENTS 3,221,603 A 12/1965 Lochhead
3,257,749 A 6/1966 Donaldson
3,559,940 A 2/1971 Kruzell
3,651,736 A 3/1972 Ingram et al.
3,745,682 A 7/1973 Waldeisen
3,979,849 A 9/1976 Haskins
4,244,273 A 1/1981 Langendorfer et al.
4,295,410 A 10/1981 Patenaude et al.
4,672,762 A 6/1987 Nilsson
4,827,652 A 5/1989 Martin
4,920,855 A 5/1990 Waters
5,148,619 A 9/1992 Badali
5,551,179 A 9/1996 Young
6,131,324 A 10/2000 Jewell
6,681,677 B2 1/2004 Herring
7,302,881 B1 12/2007 Tertin
7,316,091 B1 1/2008 DeSomma
7,444,775 B1 11/2008 Schuetz
7,849,777 B1 12/2010 Zedrosser
8,117,954 B1 2/2012 Davis
(Continued)

OTHER PUBLICATIONS

Ruger, Exploded View (of 10/22 carbine rifle), Published on the internet at: http://www.ruger.com/products/1022Carbine/extras.html, "Exploded View," 2013, Sturm, Ruger, & Co., Inc.All, 1 page.
(Continued)

*Primary Examiner* — Reginald S Tillman, Jr.
(74) *Attorney, Agent, or Firm* — Schacht Law Office, Inc.; Dwayne Rogge

(57) ABSTRACT

Disclosed herein is a hand guard attachment system comprising: a barrel nut configured to be attached to a firearm; the barrel nut having an outer surface; and a cam lever rotatable from a first position allowing the hand guard to be longitudinally positioned about the barrel nut to a second position clamping the hand guard onto the barrel nut. The hand guard attachment system may be arranged wherein the hand guard is rotationally adjustable without indexing relative to the barrel nut. The hand guard attachment system may comprise a longitudinal locking system cooperating with the clamping system and prohibiting longitudinal movement of the hand guard relative to the barrel nut when engaged.

3 Claims, 5 Drawing Sheets

(56) References Cited

U.S. PATENT DOCUMENTS

| | | | | |
|---|---|---|---|---|
| 8,561,335 | B2 | 10/2013 | Brown | |
| 8,590,197 | B1 | 11/2013 | Sylvester | |
| 8,590,199 | B2 | 11/2013 | Overstreet et al. | |
| 8,596,185 | B1 | 12/2013 | Soong et al. | |
| 8,745,909 | B1 | 6/2014 | Sylvester | |
| 8,931,196 | B1 * | 1/2015 | Larue | F41A 11/04 42/71.01 |
| 9,297,609 | B2 * | 3/2016 | Burt | F41A 21/48 |
| 9,372,038 | B1 | 6/2016 | Sylvester | |
| 9,377,258 | B2 | 6/2016 | Gomez | |
| 9,476,663 | B2 * | 10/2016 | Selvetti | F41A 11/02 |
| 9,605,924 | B1 | 3/2017 | McCaslin | |
| 9,625,225 | B2 | 4/2017 | Sylvester | |
| 9,733,031 | B1 | 8/2017 | Sylvester et al. | |
| 10,041,751 | B2 | 8/2018 | Sylvester et al. | |
| 10,704,860 | B2 * | 7/2020 | Hall | F41A 11/04 |
| 2004/0069137 | A1 | 4/2004 | Jebsen et al. | |
| 2005/0188577 | A1 | 9/2005 | Popikow | |
| 2006/0277810 | A1 * | 12/2006 | Leitner-Wise | F41G 11/003 42/75.03 |
| 2010/0282066 | A1 | 11/2010 | Tankersley | |
| 2011/0061523 | A1 | 3/2011 | Webb | |
| 2011/0209607 | A1 | 9/2011 | St. George | |
| 2012/0102803 | A1 | 5/2012 | Troy et al. | |
| 2013/0098235 | A1 | 4/2013 | Reinken | |
| 2014/0090283 | A1 | 4/2014 | Gomez | |
| 2014/0224103 | A1 | 8/2014 | Brown | |
| 2014/0224114 | A1 | 8/2014 | Faxon | |
| 2015/0053072 | A1 | 2/2015 | Bunker | |
| 2019/0154396 | A1 * | 5/2019 | Zinsner | F41A 11/04 |
| 2020/0124373 | A1 * | 4/2020 | Juarez | F41A 21/485 |
| 2020/0232753 | A1 * | 7/2020 | Chin | F41A 11/00 |

OTHER PUBLICATIONS

Ruger, Instruction Manual (10/22 Carbine Rifle), Published on the internet at: http://www.ruger.com/products/1022Carbine/extras.html, "instruction Manual," 2013 Sturm, Ruger, & Co., Inc.ALI, 52 pages.

* cited by examiner

FIREARM HANDGUARD SYSTEM

RELATED APPLICATIONS

This application claims priority of U.S. Provisional Patent Application Ser. No. 62/850,463 filed on May 20, 2019 incorporated herein by reference.

BACKGROUND OF THE DISCLOSURE

Field of the Disclosure

The disclosure relates to a hand guard for a firearm, and more particularly relates to a hand guard assembly for quickly, easily, securely attaching a hand guard radial adjustability to a firearm using a cam.

BRIEF SUMMARY OF THE DISCLOSURE

A hand guard attachment system is disclosed herein comprising in one example a barrel nut configured to be attached to a firearm. The barrel nut having an outer surface; and cooperating with a cam lever rotatable from a first position allowing the hand guard to be longitudinally positioned about the barrel nut to a second position clamping the hand guard onto the barrel nut.

The hand guard attachment system may be arranged wherein the hand guard is rotationally adjustable without indexing relative to the barrel nut.

The hand guard attachment system may comprise a longitudinal locking system cooperating with the clamping system and prohibiting longitudinal movement of the hand guard relative to the barrel nut when engaged.

DETAILED DESCRIPTION OF THE DISCLOSURE

Disclosed herein is a firearm handguard system 120 configured to be attached to a firearm. The hand guard system 120 employing a new attachment which allows for radial adjustment, ease in installation, ease in removal, and ease in replacement of the hand guard 120 to the firearm.

In the field of firearms, it is often desired to grasp the portion of the firearm surrounding the barrel and/or gas tube, to attach accessories to this same area, to protect the barrel from impact, and to protect clothing, skin etc. from the barrel which may become hot from use and is often too small in diameter to grasp and may have a smooth surface not easily held.

Figure 4:
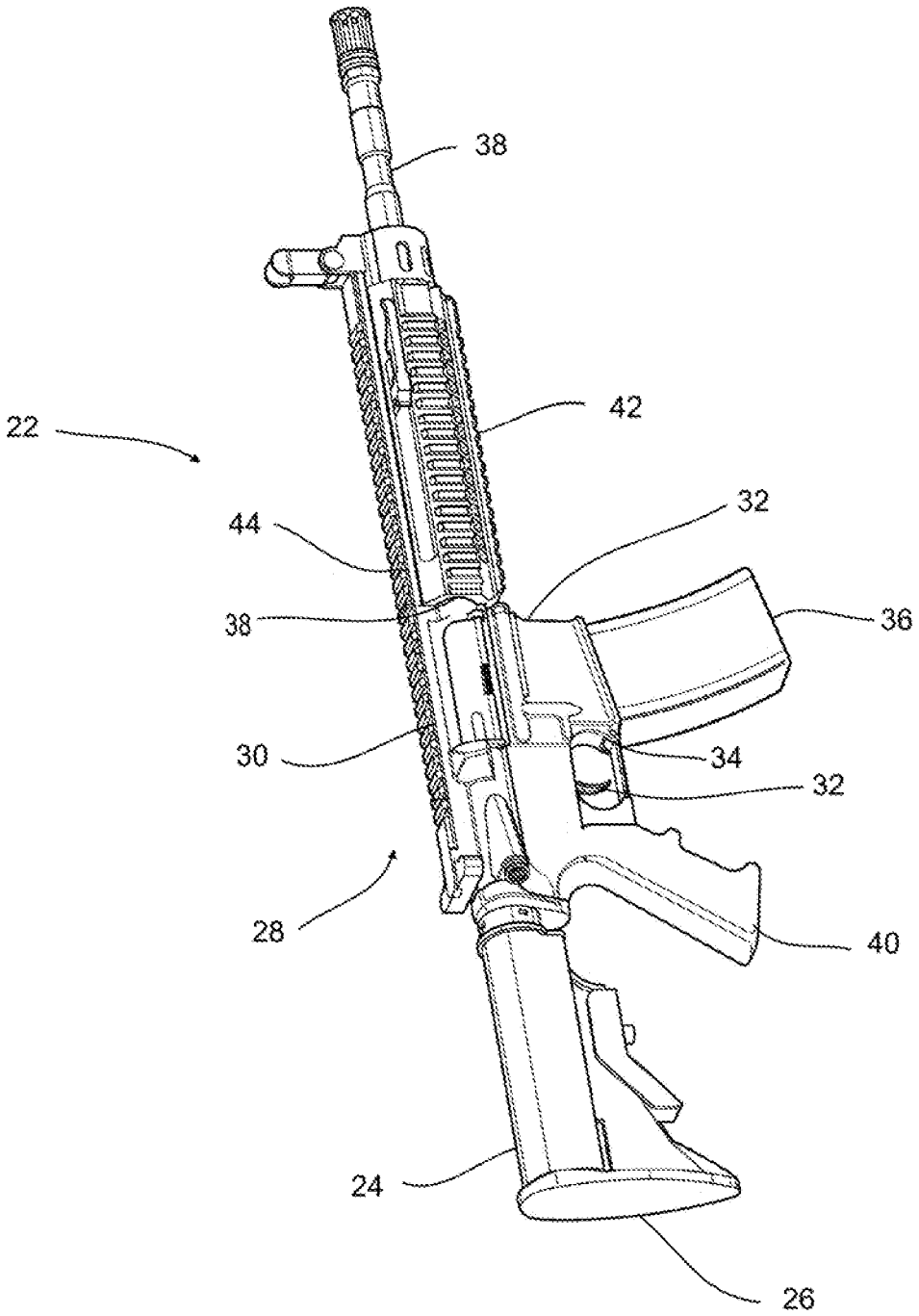
Fig. 4 Prior Art
FIG. 4 is a side perspective view of a prior art firearm.

Thus, hand guards of varying configurations have been disclosed including that disclosed in U.S. Pat. No. 8,561,335 incorporated herein by reference. FIG. 4 for example shows such hand guards that are attached in varying means to other components of the firearm to ensure stability of the handguard in rugged environments often encountered when using such firearms.

FIG. 4 shows a prior art firearm 22 comprising an optional stock 24 with a butt or end plate 26 which generally rests against an operator's shoulder in use. A receiver 28, in one example comprising an upper receiver 30 and lower receiver 30 is attached to the stock 24. Often, such firearms 22 comprise a trigger 32 and magazine well 34 for ease in operation. A magazine 36 removably fits into the magazine well 34 and holds cartridges for operating the firearm 22 in a known manner. A barrel 38 extends from the receiver 28 and is hollow such that projectiles (bullets) are forcibly ejected from the firearm 22 during operation.

In assault-style firearms 22, a grip 40 is often provided, generally extending from the receiver 28 and grasped by the operator in one hand such that the trigger 32 may be reached by the operator while the grip 40 is held in the same hand as used to manipulate the trigger. The operator's other hand often grasps the firearm 22 around the hand guard 42. The hand guard 42 having a proximal end 44 attached to the receiver 28 in one of many ways known in the art.

Hand guards 42 often are vented, and often have attachment systems for lights, accessories, sights, etc.

Figure 5:
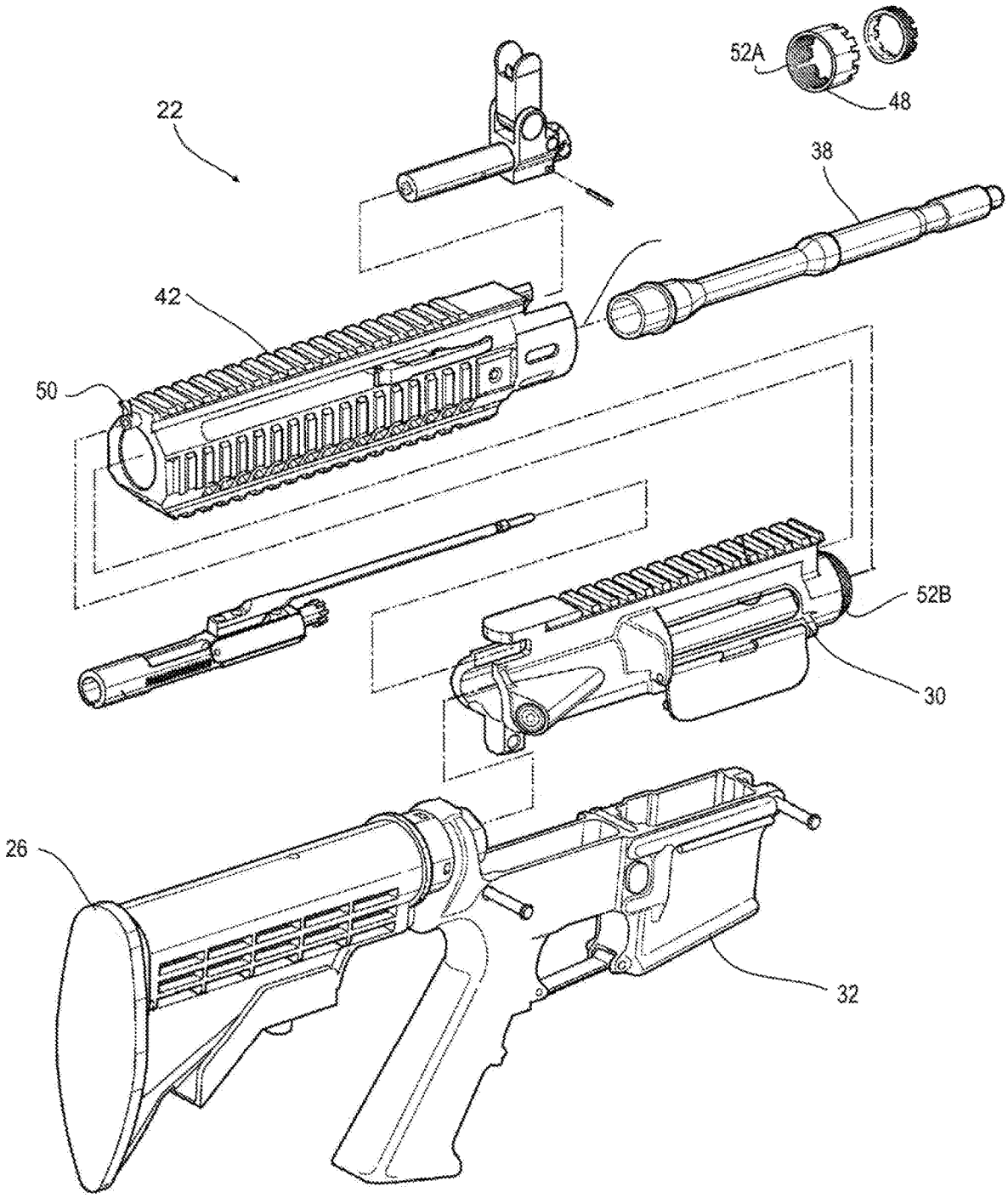
Fig. 5 Prior Art
FIG. 5 is a partially exploded view of the example shown in FIG. 4.
Figure 6:
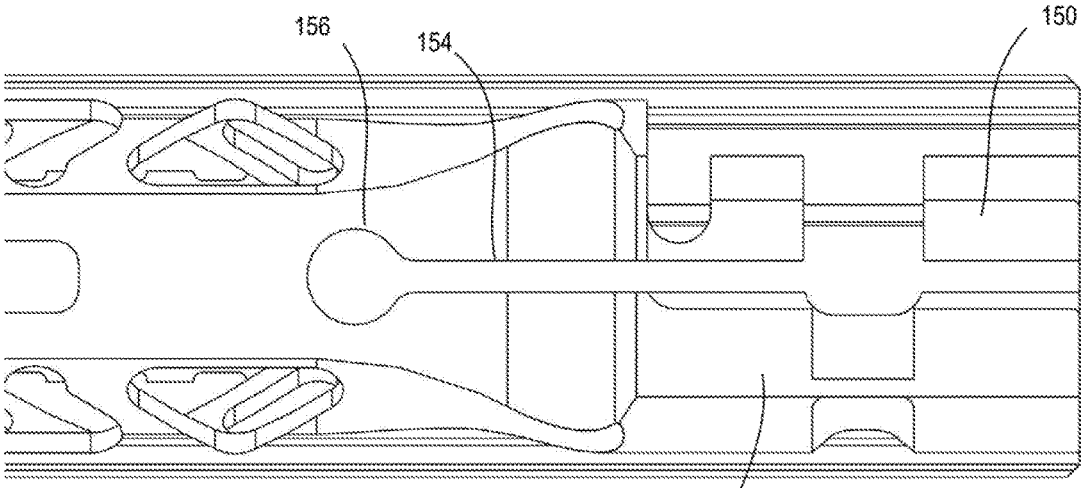
FIG. 6 is an enlarged view of the region 6 of FIG. 2.

FIG. 5 is an exploded perspective view of one embodiment of a hand guard 42 positioned adjacent to a portion of the firearm 22. The firearm 22 may be a conventional firearm, or an assault-style firearm. For example, the firearm 22 may be an M-16 style rifle, an AR-15 style rifle, an AR-10 style rifle, an M-4 style rifle, a hunting style rifle, a target style rifle, a sniper-style rifle, among others. As shown in FIG. 5, the firearm 22 may include an upper receiver 30 and a barrel 38. The upper receiver 30 generally houses internal components of the firearm 22 not shown in detail in the Figs. But well known in the art. The barrel 38 extends from the upper receiver 30 along a longitudinal axis 46 and may be secured or otherwise mounted to the upper receiver 30 using a barrel nut 48.

Often these hand guard attachment systems employ an attachment system, such as a barrel nut 48 having a female threaded surface 52A is attached to the male threaded surface 52B of the receiver 28 of the firearm 22. An indexing surface 50 provides for circumferential positioning of the hand guard 42 relative to the upper receiver 30. This system and other indexed adjustment systems are not rotationally adjustable, they also require removal of one or more threaded components, such as barrel nut 48 and a lock nut to remove the barrel 38 and hand guard 42.

Thus is disclosed herein a novel hand guard system 120 allowing for easy attachment of a hand guard 122 without any specialized tools. This attachment may be accomplished quickly, easily, and in one example the attachment structure allows for circumferential adjustment of the hand guard 122 relative to the receiver 28. This adjustment may be provided without index surfaces, allowing for analog (non-indexed) circumferential adjustment of the hand guard 122 relative to the firearm 22. The system 120 also provides quick and easy removal and replacement of the hand guard 122 from the receiver 28. For example, a user may wish to replace the hand guard 122 with a shorter hand guard 122 or with a hand guard 122 having a different configuration or design.

Figure 7:
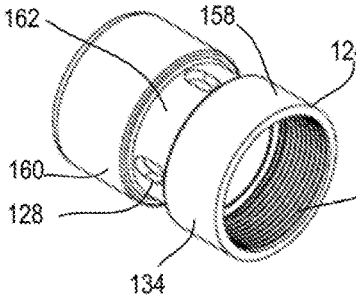
FIG. 7 is an exploded view showing a barrel nut component of the disclosed firearm handguard system as shown in FIG. 1.
Figure 8:
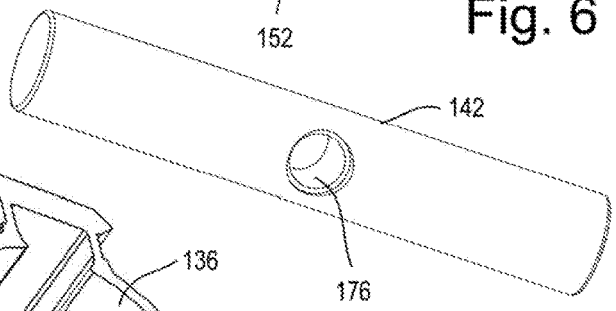
FIG. 8 is an exploded view showing a pivot pin component of the disclosed firearm handguard system as shown in FIG. 1.
Figure 9:
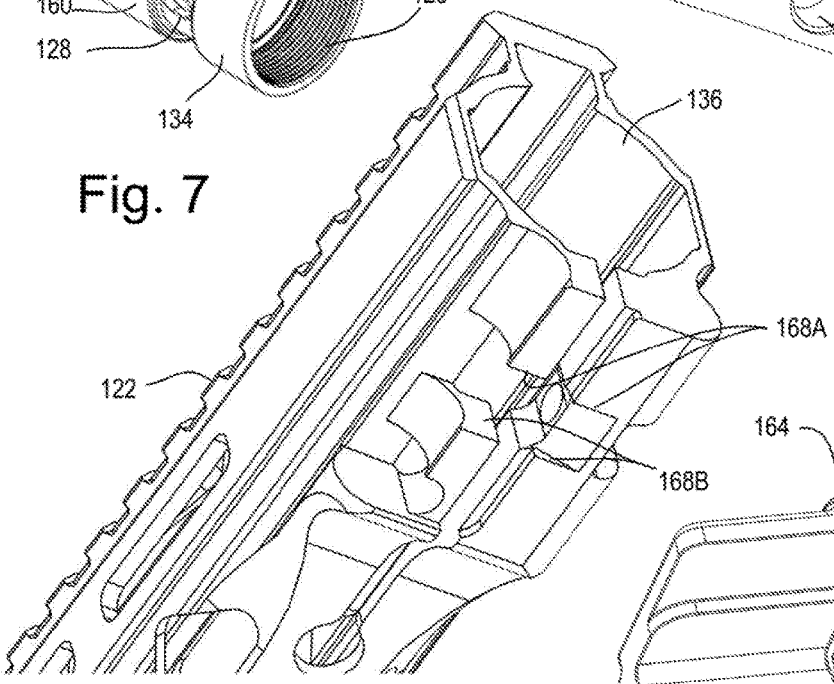
FIG. 9 is a bottom perspective view substantially of the region 6 of FIG. 2 with several components removed.

Looking to FIG. 7 is shown a novel barrel nut 124. This example of a barrel nut 124 having a female threaded surface 126 configured to thread onto the male threaded surface 52B of the upper receiver 30 shown in FIG. 5. This example barrel nut 124 also having one or more tool engagement surfaces 128 configured to be engaged by engagement surfaces 130 of a hand-held tool 132 to tighten and properly affix the barrel nut 124 to the receiver 28. These surfaces may also be used to loosen and remove the barrel nut 124 from the receiver 28. Where the receiver 287 comprises other engagement methods, these surfaces and components of the barrel nut 124 may be provided in different configurations.

The barrel nut 124 of this example comprises an outer surface 134 which slides into an inner surface 136 of the hand guard 122. In one example the sliding engagement of these surfaces allows rotation of the hand guard 122 around the barrel nut 124. The positioning of an engaging surface 166 of the cam lever 140 to a groove 162 in the barrel nut 124 substantially restricts longitudinal movement along the axis of the barrel 38.

To lock position of the hand guard 122 relative to the barrel nut 124, a clamping or latching system 138 is provided. The latching system 138 of this example comprising the cam lever 140 which rotates about a cam pin 142. The cam lever 140 having an eccentric surface 144 which slides against a surface 146 of the hand guard 122. By rotation of the cam lever 140 relative to the hand guard 122, the cam pin 142 places a tension screw 148 in tension and compresses a first side 150 of the latching system 138 towards a second side 152, reducing the diameter of the inner surface 136 of the hand guard 122 against the outer surface 134 of the barrel nut 124 thus locking position of the hand guard 122 relative to the barrel nut 124.

Figure 1:
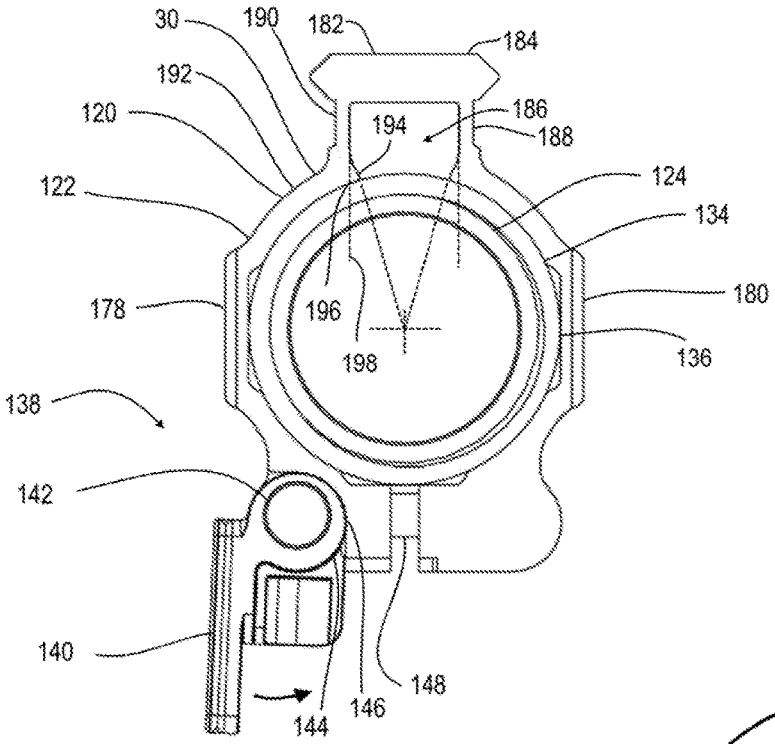
FIG. 1 is an end view of one example of the disclosed firearm handguard system.
Figure 2:
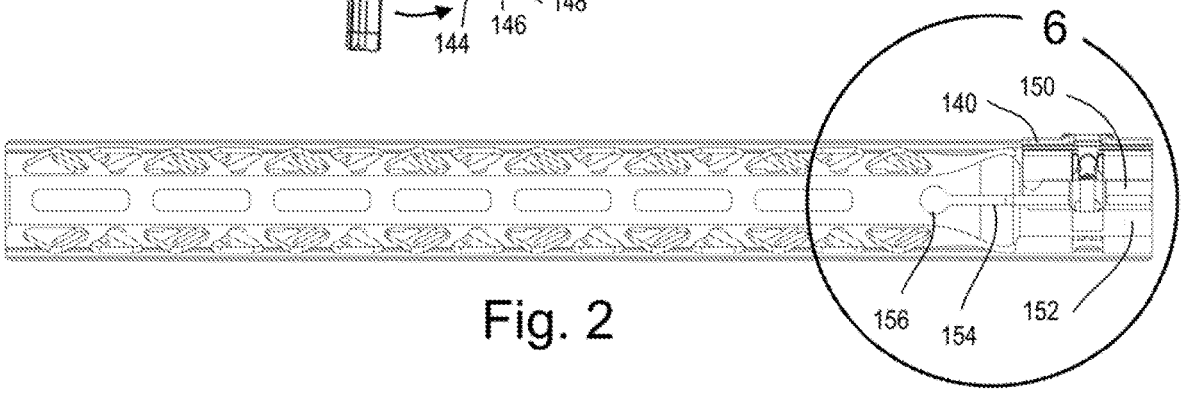
FIG. 2 is a bottom view of the example shown in FIG. 1.
Figure 3:
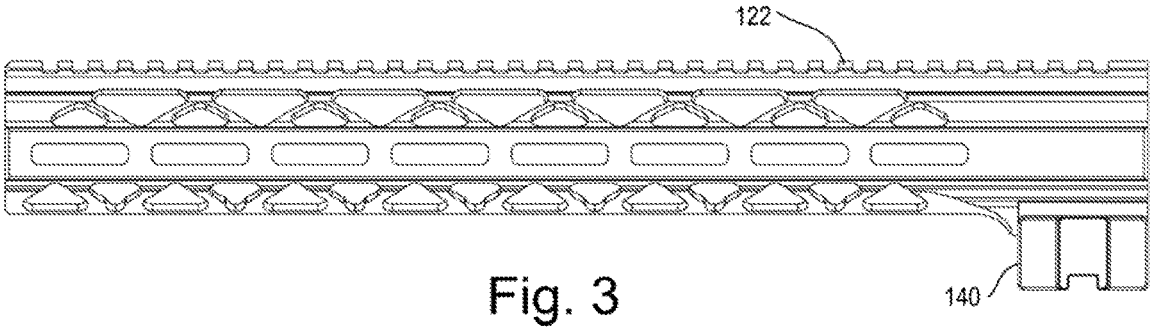
FIG. 3 is a side view of the example shown in FIG. 1

Looking to the bottom view shown in FIG. 2, one example of the hand guard system is shown where the gap 154 between the first side 150 and the second side 152 is substantially longer than the length of the cam lever 140 measured in the same direction. This long gap 154 reduces the closing (locking) resistance of the hand guard 122 against the outer surface 134 of the barrel nut 124. In addition, the gap 154 may include and enlarged portion 156 configured to distribute compression and expansion forces and thus avoid metal fatigue and cracking of the handguard 122.

In the example shown in FIG. 7, the barrel nut 124 has substantially cylindrical end portions 158, 160 having a first diameter only slightly smaller (in one example −0.001" to −0.0026") than the inner diameter of the inner surface 136 of the hand guard 122. To reduce longitudinal movement, a groove 162 may be provided longitudinally relative to the long axis of the handguard 122 between the end portions 158, 160. The groove 162 in this example having a second diameter smaller than the first diameter of the end portion 158 and/or 160.

Figure 10:
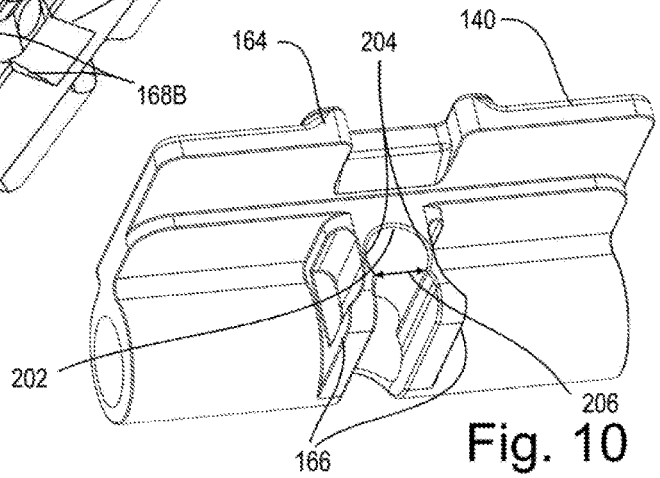
FIG. 10 is a perspective view of a cam lever component of the disclosed apparatus.
Figure 11:
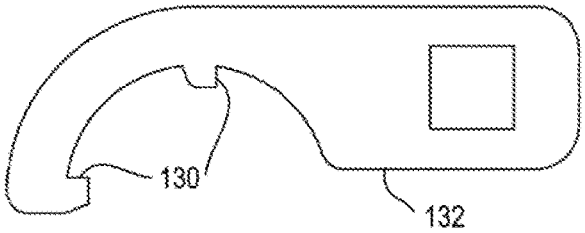
FIG. 11 shows one example of a tool used in the disclosed system to tension the barrel nut on the firearm.
Figure 12:
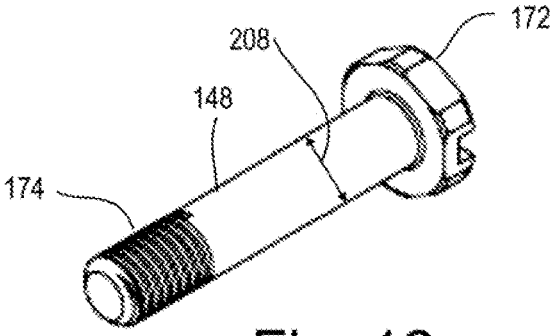
FIG. 12 shows one example of an adjustable tension bolt used in the disclosed system.

In FIG. 10 is shown the cam lever 140 with a user engagement surface 164 which can be pressed against by a user to rotate the cam lever 140 about the pivot pin 142. As mentioned, this compresses the inner surface 136 of the hand guard 122 against the outer surface 134 of the barrel nut 124, thus resisting rotational forces and optionally allowing analog rotation of the hand guard 122 relative to the barrel nut 124. In addition, in one example, this rotation presses slide lock surfaces 166 9166A, 166B) into the groove 162. Thus, longitudinal forces tending to move the hand guard 122 longitudinally are transferred from the hand guard, to the attached cam lever 140 through surfaces 168 (168A, 168B) of the hand guard 122 and surfaces 166 of the cam lever 140. Portions of the surfaces 166 also engage side surfaces 170A, 1706 of the groove 162 as shown in FIG. 13 where the hand guard 122 is not shown, and thus lock the hand guard 122 from moving longitudinally along the barrel nut 124.

Figure 13:
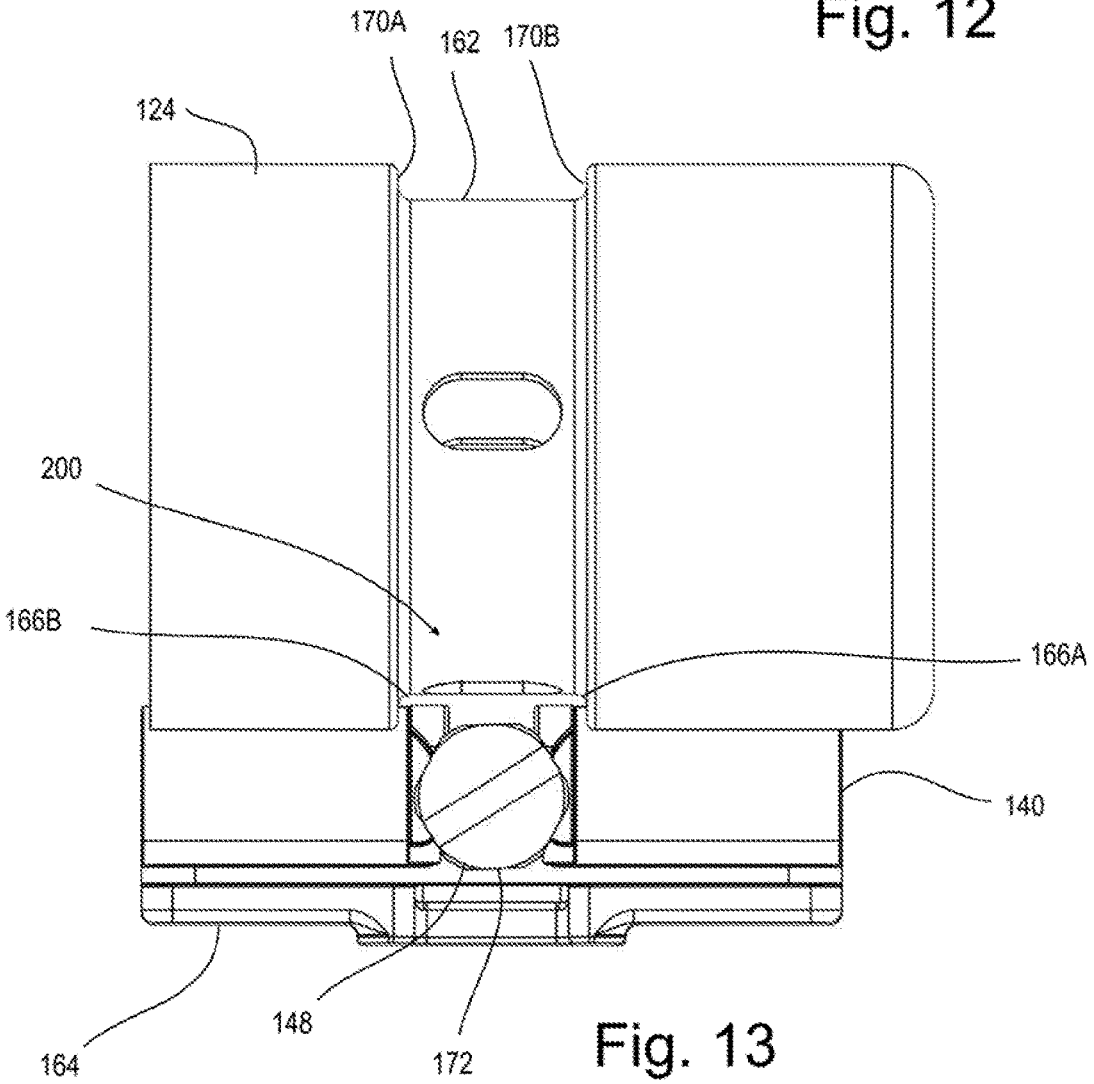
FIG. 13 is a side enlarged view of several components of the disclosed system.

FIG. 13 also shows a tool engagement surface 172 which a user engages with a tool such as for example a screwdriver to rotate the tension screw 148 such that male threads 174 engage female threads 176 of the pivot pin 142 and thus provide for longitudinal movement and adjustability of the clamping force exerted on the barrel nut 124 by the inner surface 136 of the hand guard 122 when the cam lever 140 is rotated to the latched position shown in FIG. 13.

In one example, the inner surface 136 is in sliding contact with the outer surface 134 of the barrel nut 124 as the hand guard 122 is longitudinally slid onto the barrel nut 124 as a sliding fit. A sliding fit provides minimal clearances (in one example on the order of 0.001" to 0.0026") for high accuracy requirements, which can be easily assembled and will turn & slide freely—e.g. guiding of shafts, sliding gears, crankshaft journals. As the cam lever 140 is rotated to the latched position, the hand guard 122, the inner surface 136 circumferentially compresses against the outer surface 134 of the barrel nut 124, thus holding the components in place relative to each other. In some applications the side surfaces 178, 180, and/or top surface 182 comprise rail mounts 184. Deformation of a rail mount 184 may cause the rail mount to cease to function for its intended purpose. Thus is disclosed a radial recess 186 extending radially outward from the barrel nut 124 such that elasticity is provided on either circumferential side of the recess 186. To accomplish this, in one example the circumferential sides 188 and 190 may be of a thinner material than the circumferential wall 192 of the hand guard 122.

In one example, circumferential protrusions 194 are provided. A surface of these protrusions 194 are in contact with the outer surface of the barrel nut 124 and extend from the point 196 where a line 198 extending from the sides 188/190 crosses the outer surface 134 of the barrel nut 188. These protrusions 194 add additional material to the hand guard 122 and result in less detrimental deformation of the hand guard 122, especially at the rail mounts 184.

In one example, the cam lever 140 is formed of a malleable and/or friction reducing material such as nylon, homopolymer resin, high density polyethylene, or equivalents.

To ensure the cam lever 140 does not release the hand guard 122 from the barrel nut 188, a latching system 200 may be utilized to hold the cam lever 140 in position against undesired release. In one example, the cam lever 140 as shown in FIG. 10 comprises a surface 202 which partially encircles the tension screw 148. The tension screw 148 having a diameter equivalent to or smaller than the width of the surface 202 such that the tension screw 148 fits within the surface 202.

In one example this latching system comprises surfaces most easily seen in FIG. 10 wherein the surface 202 comprises side surfaces 204 which have an entrance diameter 206 slightly smaller than the diameter 208 of the tension screw 148. Thus, as the surfaces 204 pass the tension screw 148 the diameter 206 is enlarged due to the elastic properties of the latching system 200 (e.g. plastic cam lever 140) and then returns to shape as the tension screw 148 passes the entrance opening diameter 206. This arrangement latching the cam lever 140 in the closed position shown in FIG. 13 until a significant unlatching force is engaged against the cam lever 140. Effectively, this latching system 200 reduces or eliminates accidental release of the hand guard 122 from the barrel nut 188.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept. The invention illustratively disclosed herein suitably may be practiced in the absence of any element which is not specifically disclosed herein.

The invention claimed is:

1. A hand guard attachment system comprising: a barrel nut configured to be attached to a firearm; the barrel nut comprising a cylindrical outer surface; the barrel nut having a female threaded inner surface configured to engage male threads of an upper receiver of the firearm; a hand guard having a cylindrical inner surface configured to longitudinally and rotatably engage the cylindrical outer surface of the barrel nut; the hand guard having a longitudinally extending gap defined by a first circumferential side of the cylindrical inner surface of the hand guard and a second circumferential side of the cylindrical inner surface of the hand guard a clamping system comprising a cam lever rotatable from a first position to a second position about a cam pin; a tension screw extending from the cam pin, through the first circumferential side of the gap to the second circumferential side of the gap; the cam lever having an eccentric surface relative to the cam pin, the eccentric surface in contact with the first circumferential side of the gap; and wherein rotation of the cam lever relative to the hand guard about the cam pin tensions the tension screw, pressing the second circumferential side of the gap towards the first circumferential side of the gap, pressing the cylindrical inner surface of the hand guard against the cylindrical outer surface of the barrel nut.

2. The hand guard attachment system as recited in claim 1 wherein the hand guard is rotationally adjustable without indexing relative to the barrel nut.

3. The hand guard attachment system as recited in claim 1 comprising a locking system cooperating with the barrel nut and prohibiting longitudinal movement of the hand guard relative to the barrel nut when engaged.

* * * * *